United States Patent [19]

Morrisette

[11] Patent Number: 4,469,153

[45] Date of Patent: Sep. 4, 1984

[54] APPARATUS FOR MIXING AND DISPENSING LIQUIDS

[75] Inventor: Milton J. Morrisette, Ashland, Mass.

[73] Assignee: Kidde, Inc., Saddle Brook, N.J.

[21] Appl. No.: 263,873

[22] Filed: May 15, 1981

[51] Int. Cl.[3] ..... B65B 3/04

[52] U.S. Cl. ..... 141/364; 92/255; 366/256; 366/333

[58] Field of Search ..... 141/9, 1, 18, 27, 382, 141/363, 364, 365, 366, 382–386; 92/255; 366/129, 130, 255, 256, 260, 332, 333, 334, 335

[56] References Cited

U.S. PATENT DOCUMENTS

| | | | |
|---|---|---|---|
| 3,164,303 | 1/1965 | Trautman | 366/333 |
| 3,475,010 | 10/1969 | Cook et al. | 366/333 |
| 3,700,215 | 10/1972 | Hardman et al. | 366/332 |
| 4,371,094 | 2/1983 | Hutter | 366/333 |

*Primary Examiner*—Houston S. Bell, Jr.

*Attorney, Agent, or Firm*—John E. Toupal; Harold G. Jarcho

[57] ABSTRACT

Disclosed is a mixing and dispensing system including a tubular housing with an inlet opening for receiving a first liquid ingredient and a tubular casing for retaining a second liquid ingredient to be combined therewith. A piston is longitudinally movable in the tubular casing to force the second liquid through an outlet opening that liquid tightly engages the inlet opening of the tubular housing. Extending through an end of the tubular housing opposite to the inlet opening is a rod having an inner end secured to a seal mechanism for contacting the inlet to liquid tightly seal the inlet opening. The rod also extends through and is longitudinally movable within a passage in a plunger having an outer periphery conforming to the inner walls of the tubular housing. A coupling mechanism is operable to selectively secure the plunger to the rod so as to provide common longitudinal movement thereof.

19 Claims, 6 Drawing Figures

APPARATUS FOR MIXING AND DISPENSING LIQUIDS

BACKGROUND OF THE INVENTION

This invention relates generally to a cable splice assembly and, more particularly, to an electrical conductor cable splice assembly.

Ends of electrical cables must often be spliced together in order to complete electrical circuits connected to opposite ends of the cables. Splices are used, for example, to join the ends of a cable that has been inadvertently severed during work operations. In addition, splices are often used to join a new cable length to an existing cable in order to enlarge the area in which power is available from an existing source. Although many techniques are employed to splice electrical cable, distinct problems are presented for those applications in which the cable is used in a wet environment. In those instances, the exposed ends of joined electrical conductors must be fluid tightly sealed with suitable electrical insulation to prevent conductive moisture paths that would constitute shock or electrocution hazards. Wet environments requiring fluid tightly sealed splices are encountered, for example, in many mining operations.

A known technique for creating fluid sealed splices entails the in situ molding of an insulative material around the joined ends of electrical conductors. According to one approach, a cylindrical boot is first positioned over the ends of the joined cable and then filled through a fill opening with a settable electrically insulative resin compound. Problems associated with this technique result from any failure to completely encapsulate the exposed conductors and to create a fluid tight seal between the cylindrical boot and the cable's insulative covering. This problem is accentuated by the typically high viscosity of the resin compounds utilized. Because of that factor and deficiencies in the geometrical configuration of prior splicing boot assemblies, the attainment of completely safe, fluid tightly sealed electrical cable splices have involved very costly requirements of labor and material.

The object of this invention, therefore, is to provide relatively inexpensive, fluid tightly sealed splices of electrical cable.

SUMMARY OF THE INVENTION

The invention is a system for combining, mixing and dispensing liquids. Included in the system is a tubular housing with an inlet opening for receiving a first liquid ingredient and a tubular casing for retaining a second liquid ingredient to be combined therewith. A piston is longitudinally movable in the tubular casing to force the second liquid through an outlet opening that liquid tightly engages the inlet opening of the tubular housing. Extending through an end of the tubular housing opposite to the inlet opening is a rod having an inner end secured to a seal mechanism for contacting the inlet end to liquid tightly seal the inlet opening. The rod also extends through and is longitudinally movable within a passage in a plunger having an outer periphery conforming to the inner walls of the tubular housing. A coupling mechanism is operable to selectively secure the plunger to the rod so as to provide common longitudinal movement thereof. The use of the mated tubular housing and tubular casing facilitates the combination of viscous liquids and the subsequent dispensing thereof into a confined cavity.

In a preferred embodiment of the invention the rod comprises a smooth outer surface portion that slides freely within the plunger's passage during relative longitudinal movement therebetween. A smooth rod portion facilitates exclusive movement of the seal mechanism into sealing engagement with the inlet opening after filling of the tubular housing with the first liquid ingredient.

According to one feature of the invention, the seal mechanism comprises a disc defining mixing openings for accommodating liquid flow during longitudinal movement of the rod. After insertion of the second liquid into the tubular housing and prior to operation of the coupling mechanism, the sealing disc can be reciprocated to induce mixing flow of the combined liquids through the mixing openings.

Other features of the invention include the provision of a handle secured to an end of the rod outside the tubular housing and a releasable lock for locking the rod in a closed position with the sealing disc contacting the inlet end of the tubular housing. The handle is employed to produce reciprocating movement of the plunger and sealing disc while the releasable lock prevents inadvertent unsealing of the inlet opening prior to a time of intended use.

According to additional features of the invention, the coupling mechanism comprises threaded portions on the rod and plunger and the inlet end comprises a nozzle portion defining the inlet opening and adapted for engagement with the outlet opening of the tubular casing in a male-female relationship. These features simplify, respectively, the activation of the plunger for longitudinal movement with the rod and the sealing engagement between the tubular housing and the tubular casing during the combination of the plural liquid ingredients.

According to still another feature of the invention, the inlet end of the tubular housing comprises an annular conically shaped surface around the inlet opening and the sealing disc defines a sealing surface portion that conforms thereto and a plug portion adapted for sealing engagement within the nozzle. These structural features help insure the formation of a fluid tight seal between the sealing disc and the inlet end of the tubular housing.

In a preferred embodiment of the invention, the tubular casing is identical to the tubular housing except for the provision of a modified snout that mates with the nozzle on the tubular housing. In addition to simplifying manufacture of the dual tubular elements, this features establishes for the tubular casing all of the advantages described above in connection with the tubular housing.

DESCRIPTION OF THE DRAWINGS

These and other features and objects of the invention will become more apparent upon a perusal of the following description taken in conjunction with the accompanying drawings wherein.

DESCRIPTION OF THE PREFERRED EMBODIMENT

Figure 1:
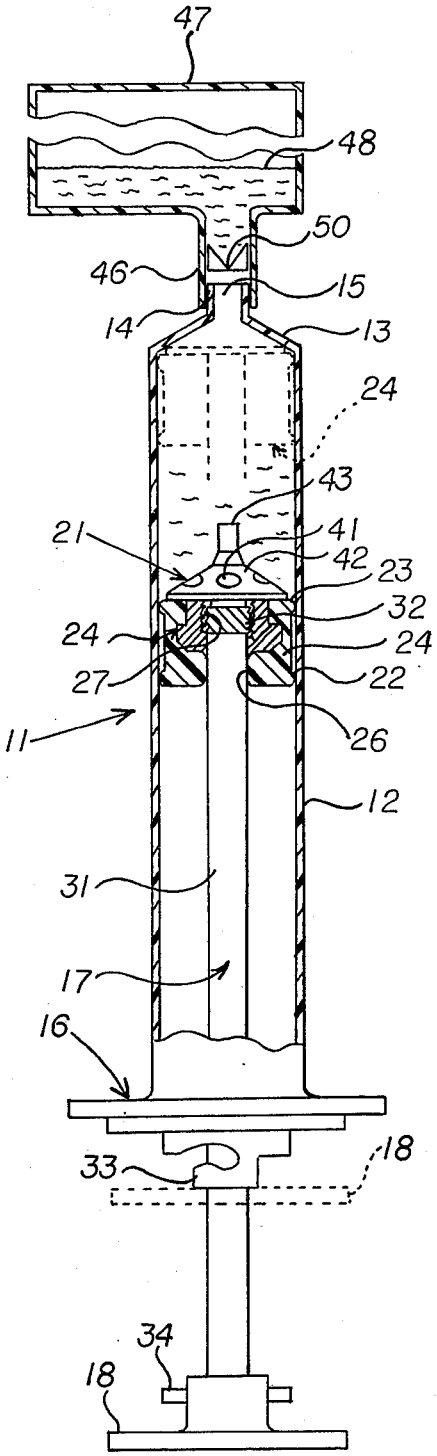
FIG. 1 is a schematic cross-sectional view of a first element of the invention.
Figure 2:
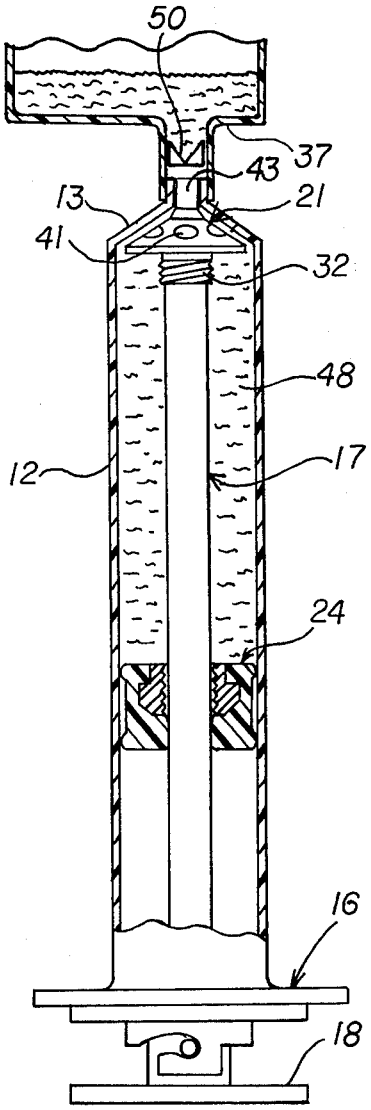
FIG. 2 is a schematic cross-sectional view of the element shown in FIG. 2 with certain components in different positions.
Figure 3:
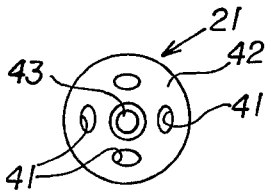
FIG. 3 is a schematic end view of a sealing disc shown in FIGS. 1 and 2.

Illustrated in FIG. 1 is a mixing and dispensing unit 11 according to the invention. The unit 11 includes a tubular housing 12 having an inlet end 13 with a nozzle portion 14 that defines an inlet opening 15. The opposite end of the tubular housing 12 is closed by a cap assembly 16. Extending through the cap assembly 16 and longitudinally movable within the tubular housing 12 is an elongated rod 17. A handle 18 is attached to an outer end of the rod 17 while a sealing disc 21 is secured to an inner end thereof. Located within the tubular housing 12 and having spaced apart annular ridges 22, 23 conforming thereto is a plunger 24. The plunger 24 possesses a central passage defined by an annular seal portion 26 and a threaded portion 27 axially aligned therewith. Included along the surface of the rod 17 are an elongated smooth portion 31 that is slidably accommodated by the plunger's seal portion 26 and an externally threaded portion 32 located adjacent to the sealing disc 21 and engageable with the threaded passage portion 27. The cap assembly 16 includes a female part 33 of a bayonet lock mechanism while a male portion 34 thereof is fixed to the handle 18. As shown in FIGS. 2 and 3, the sealing disc 21 possesses a plurality of circumferentially distributed mixing openings 41, a conically shaped surface 42 that conforms to an inner surface of the inlet end 13 of the tubular housing 12 and a centrally located plug portion 43 that enters into and produces a fluid tight seal with the inlet nozzle 14.

The unit 11 is preferably used for mixing and dispensing hard setting polymer materials such as liquid epoxies and liquid catalysts therefor. Initially, the nozzle 14 of the tubular housing 12 is inserted into a supply nozzle 46 of a vessel 47 filled with a liquid substance 48. The handle 18 and the rod 17 then are pulled away from the tubular housing 12 moving the plunger 24 and the sealing disc 21 from the positions shown by dotted lines in FIG. 1 to the positions shown by solid lines therein. This movement of the plunger 24 creates a suction that draws liquid 48 from the vessel 47 through a check valve 50 in the supply nozzle 47 and into the tubular housing 12. When the plunger 24 has reached the position shown in FIG. 2 and corresponding to the entry of a desired quantity of the liquid 48, the threaded portions 27 and 32 are disengaged by rotation of the rod 17. During this operation, the frictional pressure exerted between the sealing ridges 22, 23 and the inner surface of the tubular housing 12 prevent rotation of the plunger 24. After decoupling of the rod 17 and the plunger 24, the handle 18 is pushed inwardly moving the sealing assembly 21 into engagement with the end 13 of the tubular housing 12 as shown in FIG. 2. During this movement of the sealing disc 21, the liquid within the tubular housing 12 passes through the mixing openings 41. Ejection of liquid through the inlet opening 15 during movement of the disc 21 is prevented by the check valve 50. After the sealing disc 21 has reached its sealed position, the handle 18 is rotated to engage the bayonet lock components 33, 34 and thereby insure maintenance of the sealed condition.

Figure 4:
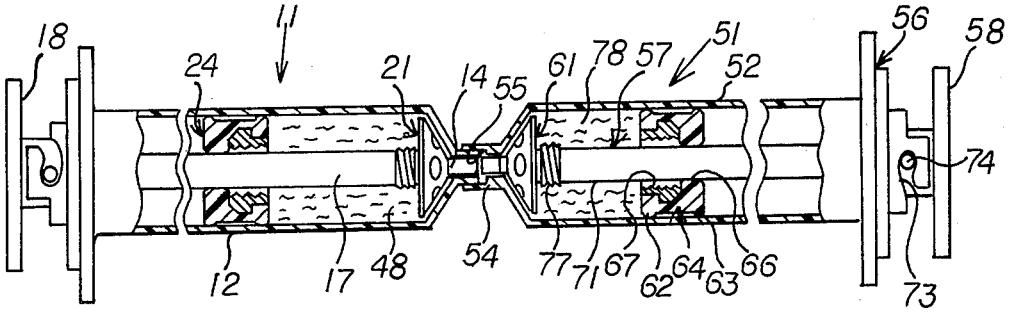
FIG. 4 is a schematic cross-sectional view of the element shown in FIGS. 1 and 2 and mated with another element of the invention.

Referring now to FIG. 4, the unit 11 is shown connected to a second unit 51 of the invention. The unit 51 includes a tubular casing 52 having an outlet end with a nozzle portion 54 that defines an inlet opening 55. The opposite end of the tubular casing 52 is closed by a cap assembly 56. Extending through the cap assembly 56 and longitudinally movable within the tubular casing 52 is an elongated rod 57. A handle 58 is attached to an outer end of the rod 57 while a sealing disc 61 is secured to an inner end thereof. Located within the tubular casing 52 and having spaced apart annular ridges 62, 63 conforming thereto is a piston 64. The piston 64 possesses a central passage defined by an annular seal portion 66 and a threaded portion 67 axially aligned therewith. Included along the surface of the rod 57 are an elongated smooth portion 71 that is slidably accommodated by the plunger's seal portion 66 and an externally threaded portion 77 located adjacent to the sealing disc 61 and engageable with the threaded passage portion 67. The cap assembly 56 includes a female part 73 of a bayonet lock mechanism while a male portion 74 thereof is fixed to the handle 58. Corresponding components of the units 11 and 51 are identical except for the nozzle 14 and the snout 54. As shown, the inside diameter of the snout 54 conforms to the outside diameter of the nozzle 14 so as to create a fluid tight male-female engagement therebetween. Unit 51 is filled with a suitable liquid curing agent 78 in the same manner that the unit 11 is filled with the base liquid 48.

Figure 5:
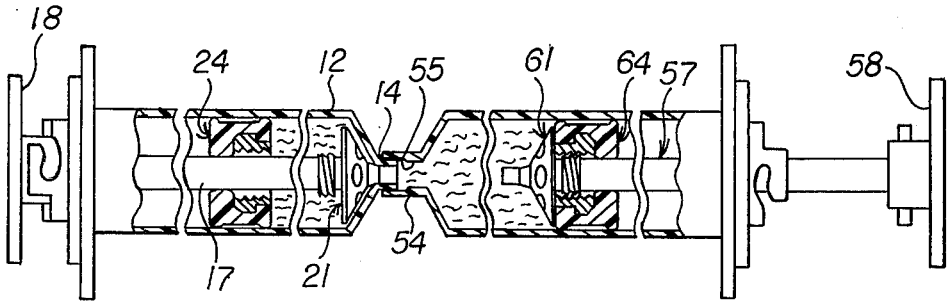
FIG. 5 is a schematic cross-sectional view similar to that shown in FIG. 4 but with certain components in different operating positions.
Figure 6:
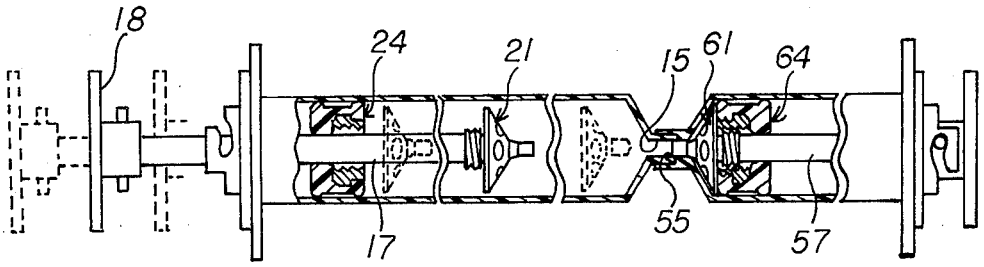
FIG. 6 is a schematic cross-sectional view similar to that shown in FIG. 5 but with the components in other operating positions.

When the liquid substances 48 and 78 are to be combined and used, the units 11 and 51 are engaged as shown in FIG. 5. The handle 58 is then manipulated to disengage the lock components 73 and 74 after which the stem 57 is withdrawn from the tubular casing 52 until the closure 61 engages the piston 64. Those components are then connected by rotating the stem 57 to engage the threaded portion 72 of the stem 57 with the threaded portion 67 of the piston 64. Next the handle 18 is manipulated to disengage the bayonet lock components 33 and 34 and the rod 17 is withdrawn until the sealing disc 21 engages and moves the plunger 24 into the position shown in FIG. 6. Next the handle 58 is forced inwardly moving the interconnected stem 57, closure 61 and piston 64 toward the outlet opening 55. This movement of the piston 64 forces the liquid 78 out of the tubular casing 52, through the outlet and inlet openings 55 and 15 and into the tubular housing 12. After total evacuation of the tubular casing 52, the handle 58 is again manipulated to engage the bayonet lock components 73 and thereby secure the closure 61 in sealing engagement over the outlet opening 55. Mixture of the liquid ingredients 48 and 78 is accomplished as shown by dashed lines in FIG. 6 by operating the handle 18 to reciprocate the sealing disc 21 within the tubular housing 12 between the plunger 24 and the inlet end 13.

After sufficient mixing of the ingredients 48 and 78, the handle 18 is fully withdrawn to engage the sealing disc 21 with the plunger 24. Rotation of the rod 17 then produces engagement between the threaded portions 27 and 32 and thereby secures the plunger 24 to the rod 17 in the manner shown in FIG. 1. After disengagement of the units 11 and 51, the nozzle 14 is inserted into the inlet of a cavity in which the combined liquids are to be injected. Finally, the handle 18 is pushed inwardly causing movement of the rod 17 and attached sealing disc 21 and plunger 24 toward the nozzle 14 and resulting in ejection therefrom of the entire liquid content within the tubular housing 12.

It will be appreciated that the force amplification provided by the piston 64 and the plunger 24, respectively, greatly facilitates first the transfer of the liquid 78 from the unit 51 to the unit 11 and subsequently the transfer of the combined and mixed ingredients 48 and 78 into a confined cavity (not shown). A suitable cavity forming unit for receiving the discharge from the tubular housing 12 is disclosed in the applicant's co-pending application entitled "Electrical Cable Splice" which was filed concurrently with this application and is commonly assigned therewith.

Obviously, many modifications and variations of the present invention are possible in light of the above teachings. It is to be understood, therefore, that the invention can be practiced otherwise than as specifically described.

What is claimed is:

1. Apparatus for combining, mixing and dispensing liquids, said apparatus comprising:

a tubular housing with an inlet end defining an inlet opening;

a rod extending through an opposite end of said housing and longitudinally movable therein, said rod comprising an elongated rod portion having a length at least substantially as great as the length of said housing;

a sealing means secured to for movement with an inner end of said rod, said sealing means adapted to contact said inlet end and to fluid tightly seal said inlet opening;

a plunger having an outer periphery conforming to an inner wall of said housing, said plunger defining a passage providing a liquid tight seal around said elongated rod portion while accommodating said longitudinal movement thereof;

coupling means operable to secure said plunger to said rod for movement therewith;

a tubular casing with an outlet end defining an outlet opening, said outlet end adapted for liquid tight engagement with said inlet end so as to provide communication between said outlet and inlet openings and permit liquid flow out of said tubular casing into said tubular housing; and piston means comprising an outer periphery conforming to an inner surface of said tubular casing and longitudinally movable therein.

2. Apparatus according to claim 1 wherein said elongated rod portion comprises a smooth outer surface portion that slides freely within said passage during said longitudinal movement thereof.

3. Apparatus according to claim 2 wherein said coupling means comprises a threaded portion of said rod adjacent to said sealing means, and a corresponding threaded portion of said passage.

4. Apparatus according to claim 2 wherein said sealing means comprises a disc defining mixing openings for accommodating liquid flow during said longitudinal movement of said rod.

5. Apparatus according to claim 2 including a handle means secured to an end of said rod outside said tubular housing, and releasable lock means for locking said rod in a closed position with said sealing means contacting said inlet end of said tubular housing.

6. Apparatus according to claim 2 wherein said inlet end comprises a nozzle portion defining said inlet opening, and said nozzle portion and said outlet opening are adapted for engagement in a male-female relationship.

7. Apparatus according to claim 6 wherein said sealing means comprises a disc defining mixing openings for accommodating liquid flow during said longitudinal movement of said rod.

8. Apparatus according to claim 7 wherein said inlet end comprises an annular conically shaped surface around said inlet opening, and said disc defines a sealing surface portion for conforming engagement with said conically shaped surface and a plug portion for sealing engagement within said nozzle.

9. Apparatus according to claim 8 wherein said coupling means comprises a threaded portion of said rod adjacent to said sealing means, and a corresponding threaded portion of said passage.

10. Apparatus according to claim 9 including a handle means secured to an end of said rod outside said tubular housing, and releasable lock means for locking said rod in a closed position with said sealing means contacting said inlet end of said tubular housing.

11. Apparatus according to claim 10 including a stem extending through an end of said tubular casing opposite said outlet opening and an orifice in said piston, a closure means secured for movement with an inner end of said stem and adapted to liquid tightly seal said outlet opening, and a connector means operable to secure said piston to said stem for movement therewith.

12. Apparatus according to claim 2 including a stem extending through an end of said tubular casing opposite said outlet opening and an orifice in said piston, a closure means secured for movement with an inner end of said stem and adapted to liquid tightly seal said outlet opening, and a connector means operable to secure said piston to said stem for movement therewith.

13. Apparatus according to claim 12 wherein said coupling means comprises a threaded portion of said rod adjacent to said sealing means, and a corresponding threaded portion of said passage.

14. Apparatus according to claim 12 wherein said sealing means comprises a disc defining mixing openings for accommodating liquid flow during said longitudinal movement of said rod.

15. Apparatus according to claim 12 including a handle means secured to an end of said rod outside said tubular housing, and releasable lock means for locking said rod in a closed position with said sealing means contacting said inlet end of said tubular housing.

16. Apparatus for combining, mixing and dispensing liquids, said apparatus comprising:

a tubular housing with an inlet end defining an inlet opening;

a plunger having an outer periphery conforming to an inner wall of said housing, said plunger defining a central passage;

a rod extending through an opposite end of said housing and through said passage and longitudinally movable therein, said rod comprising a smooth outer surface portion that slides freely within said passage and forms a liquid tight seal therewith during said longitudinal movement;

a sealing means secured to for movement with an inner end of said rod, said sealing means adapted to contact said inlet end and to fluid tightly seal said inlet opening; and coupling means operable to secure said plunger to said rod for movement therewith.

17. Apparatus according to claim 16 wherein said coupling means comprises a threaded portion of said rod adjacent to said sealing means, and a corresponding threaded portion of said passage.

18. Apparatus according to claim 16 wherein said sealing means comprises a disc defining mixing openings for accommodating liquid flow during said longitudinal movement of said rod.

19. Apparatus according to claim 16 including a handle means secured to an end of said rod outside said tubular housing, and releasable lock means for locking said rod in a closed position with said sealing means contacting said inlet end of said tubular housing.

* * * * *